US007492081B2

(12) United States Patent
Hori et al.

(10) Patent No.: US 7,492,081 B2
(45) Date of Patent: Feb. 17, 2009

(54) DISPLAY PANEL MODULE AND METHOD FOR MANUFACTURING THE SAME

(75) Inventors: Nobuyuki Hori, Miyazaki (JP); Yoshimi Kawanami, Miyazaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 520 days.

(21) Appl. No.: 11/294,343

(22) Filed: Dec. 6, 2005

(65) Prior Publication Data

US 2006/0138956 A1 Jun. 29, 2006

(30) Foreign Application Priority Data

Dec. 22, 2004 (JP) ..... 2004-372347
Nov. 8, 2005 (JP) ..... 2005-323663

(51) Int. Cl.
*H01J 1/16* (2006.01)
*H01J 61/40* (2006.01)
*H01K 1/26* (2006.01)
*H01K 1/30* (2006.01)

(52) U.S. Cl. ..... 313/112; 313/489; 313/580; 313/582; 445/24; 445/25; 445/50

(58) Field of Classification Search ..... 313/582–587; 156/258, 325, 330; 29/827, 825, 469.5, 421.1; 361/681, 719, 749; 445/24–25, 50; 427/208.4, 427/208.5, 208.6, 208.7, 208.8, 238, 350, 427/369
See application file for complete search history.

(56) References Cited

U.S. PATENT DOCUMENTS 6,359,390 B1 * 3/2002 Nagai ..... 315/169.1
6,844,684 B2 * 1/2005 Namiki et al. ..... 315/169.3
7,163,739 B2 1/2007 Koike et al.
7,343,673 B2 * 3/2008 Kim et al. ..... 29/825
2002/0050783 A1 * 5/2002 Kubota et al. ..... 313/495
2003/0176124 A1 * 9/2003 Koike et al. ..... 442/16

(Continued)

FOREIGN PATENT DOCUMENTS

EP 1 349 189 10/2003

(Continued)

OTHER PUBLICATIONS

Office Action Issued in corresponding Korean Patent Application No. 10-2005-0113314, on Jul. 5, 2007.

(Continued)

*Primary Examiner*—Sikha Roy
*Assistant Examiner*—Jose M Diaz
(74) *Attorney, Agent, or Firm*—Staas & Halsey LLP

(57) ABSTRACT

A method for manufacturing a display panel module is provided by which production costs are reduced. A method is provided for manufacturing a display panel module that includes a display panel, a functional film and a drive circuit board. The method includes attaching the drive circuit board to the display panel, conducting a lighting test of the display panel using the drive circuit board to confirm that the display panel is an acceptable product, and bonding the functional film to a front face of the display panel. In the bonding process, an adhesive layer having a thickness equal to or more than 200 microns is interposed between the front face of the display panel and the functional film.

12 Claims, 5 Drawing Sheets

U.S. PATENT DOCUMENTS

| | | | | |
|---|---|---|---|---|
| 2003/0184225 | A1* | 10/2003 | Namiki et al. | 313/582 |
| 2004/0104660 | A1* | 6/2004 | Okamoto et al. | 313/346 R |
| 2004/0113532 | A1* | 6/2004 | Oishi et al. | 313/110 |
| 2004/0165297 | A1* | 8/2004 | Kim et al. | 359/885 |
| 2004/0222003 | A1* | 11/2004 | Kim et al. | 174/35 R |
| 2006/0142412 | A1* | 6/2006 | Yamaoka et al. | 523/111 |

FOREIGN PATENT DOCUMENTS

| | | | |
|---|---|---|---|
| EP | 1 429 366 | | 6/2004 |
| EP | 1 643 277 | | 4/2006 |
| JP | 2001-13877 | | 1/2001 |
| JP | 2003240907 | A * | 8/2003 |
| JP | 2004-188953 | | 7/2004 |
| JP | 2004-206076 | | 7/2004 |
| KR | 2003-0001494 | | 1/2003 |
| KR | 10-2004-0061894 | | 7/2004 |

OTHER PUBLICATIONS

Partial European Search Report issued Oct. 1, 2008 in corresponding European Patent Application No. 05257446.4.

* cited by examiner

DISPLAY PANEL MODULE AND METHOD FOR MANUFACTURING THE SAME

BACKGROUND OF THE INVENTION

1. Field of the Invention

The present invention generally relates to display panel modules and a method for manufacturing the same and more particularly relates to improvement in plasma display modules having functional films directly bonded to front faces thereof. The display panel modules are main units of flat display devices and include a display panel, a functional film and a drive circuit board each. The display devices each include a display panel module and a casing for housing the same.

2. Description of the Related Art

The display panels are devices termed flat panel displays such as plasma display panels, liquid crystal panels, organic electroluminescence displays or field emission displays.

A translucent functional film is bonded to a front face of a display panel in order to improve performance of a display device for displaying images using the display panel. The functional film has at least a function of preventing reflection of external light. In the case of a plasma display panel, other functions realized by using the functional film include display color correction, electromagnetic wave shielding and near infrared ray shielding. For example, a functional film described in Japanese unexamined patent publication No. 2004-206076 has an anti-reflection layer, a color filter layer and an electromagnetic wave shielding layer and is bonded to a front face of a plasma display panel.

A step of bonding a functional film precedes a step of assembling a display device, i.e., of housing a display panel in a casing. More specifically, in manufacturing a display device, a display panel module provided with a functional film and a drive circuit board is manufactured first, and then, the display panel module is incorporated into a casing.

According to conventional manufacturing methods of display panel modules, a functional film is bonded to a front face of a display panel prior to attaching a drive circuit board to the display panel. This manufacturing procedure is suitable when a functional film is bonded under a clean environment such as a clean room. Since relatively much dust adheres to a drive circuit board, it is undesirable to carry the drive circuit board to a clean room. When a functional film is bonded to a display panel after attachment of a drive circuit board, much dust (many foreign matters) may be present between the functional film and the display panel.

According to conventional methods, when some defects of a display panel are found by a lighting test conducted after manufacturing a display panel module, it is necessary to detach a functional film from the defective display panel, then to discard the functional film. Alternatively, it is necessary to perform a difficult reproduction process that involves removal of surface foreign matters and attachment of a mold release film, then to bond the functional film thus reproduced to another display panel. This lowers productivity, causing a problem of increase in production costs of display panel modules. In particular, damage of a functional film at the time of detachment thereof further increases production costs.

SUMMARY OF THE INVENTION

The present invention is directed to solve the problems pointed out above, and therefore, an object of the present invention is to reduce production costs of display panel modules. More specifically, an object of the present invention is to offer high-quality plasma display modules at a reasonable price by improving adhesive layers of functional films to be bonded to front faces of display panels.

According to one aspect of the present invention, a method is provided for manufacturing a display panel module including a display panel, a functional film and a drive circuit board. The method includes attaching the drive circuit board to the display panel, conducting a lighting test of the display panel using the drive circuit board to confirm that the display panel is an acceptable product, and bonding the functional film to a front face of the display panel under an atmospheric environment. In order to make this manufacturing method possible, according to the present invention, an adhesive layer is interposed between the front face of the display panel and the functional film. The adhesive layer covers dust whose dimension is smaller than the thickness of the adhesive layer and lessens a void around the dust. Even if some dust is present on the front face of the display panel, the dust does not disturb a display, provided that a difference between a dimension of the dust and a dimension of the void around the dust is smaller than 100 microns. This Foreign matter resistance of covering dust, i.e., foreign matter coverability is so adjusted that, when the bonding process is performed with a glass bead having a diameter of 50 microns being present at an adhesive interface, the ratio between a diameter of a void generated around the glass bead and a diameter of the glass bead is equal to or less than 2.0. When the bonding process of the functional film is performed under a low atmospheric pressure environment, a void around dust is less likely to expand even if a completed display panel module is used under a low atmospheric pressure environment.

According to the present invention, it is possible to reduce production costs of display panel modules and display devices using the same.

These and other characteristics and objects of the present invention will become more apparent by the following descriptions of preferred embodiments with reference to drawings.

DESCRIPTION OF THE PREFERRED EMBODIMENTS

Figure 1:
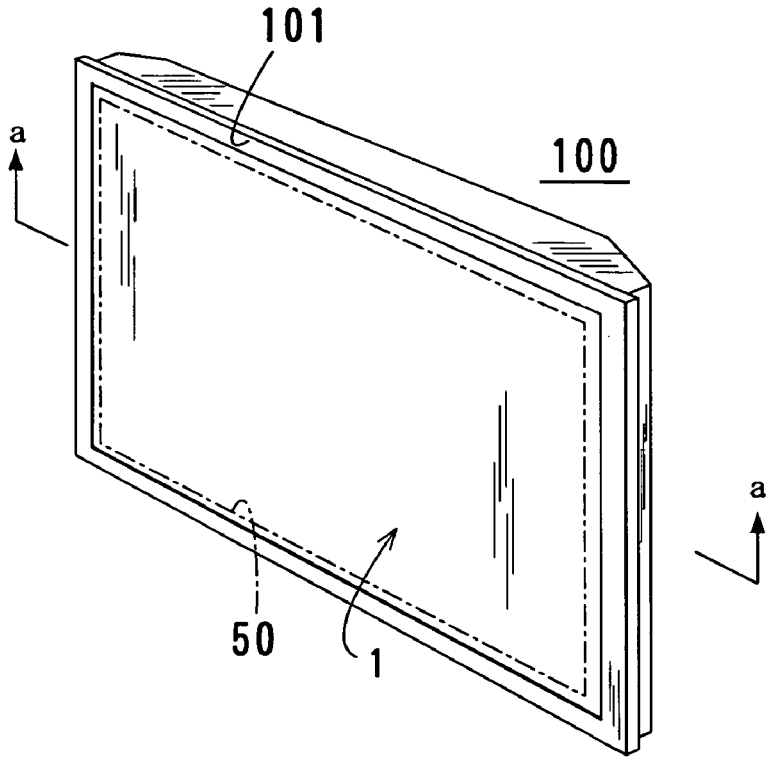
FIG. 1 shows an appearance of a plasma display device according to the present invention.

FIG. 1 shows an appearance of a plasma display device according to the present invention. A plasma display device 100 is a flat type display having, for example, a 32-inch diagonal screen 50. Dimensions of the screen 50 are 0.72 meters in the horizontal direction and 0.40 meters in the vertical direction. A facing cover 101 that defines a front face size of the display device 100 has an opening that is larger than the screen 50, so that a front face of a display panel module 1 is exposed except peripheral portions.

Figure 2:
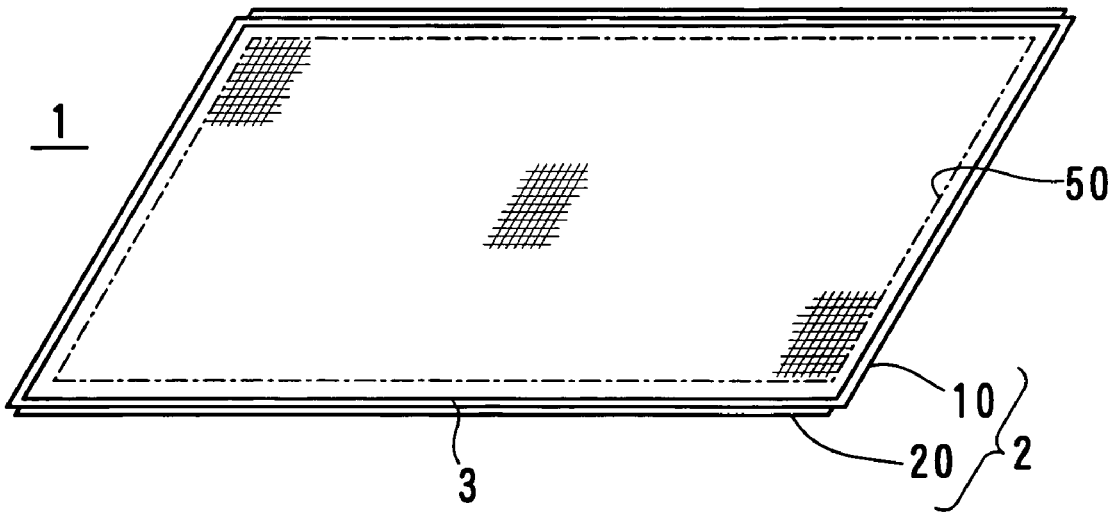
FIG. 2 is a schematic diagram of a structure of a display panel module.

FIG. 2 is a schematic diagram of a structure of the display panel module. The display panel module 1 includes a plasma display panel 2, a front sheet 3 that is bonded directly to the front face of the plasma display panel 2 and a drive circuit board (not shown). The front sheet 3 is made up of plural layers including an optical film having an optical filter function and an EMI shield film having an electromagnetic wave shielding function. The plasma display panel 2 is a self-luminous type device that emits light by gas discharge, which includes a front panel 10 and a rear panel 20. Each of the front panel 10 and the rear panel 20 includes a glass substrate having a thickness of approximately 3 mm and cell structural elements formed on a surface of the glass substrate.

The plasma display panel 2 is filled with a Penning gas that is a mixture of neon and xenon (equal to or more than 2%) as a discharge gas. This Penning gas emits near infrared rays having a wavelength of 830 nm and a wavelength of 880 nm at discharge.

Figure 3:
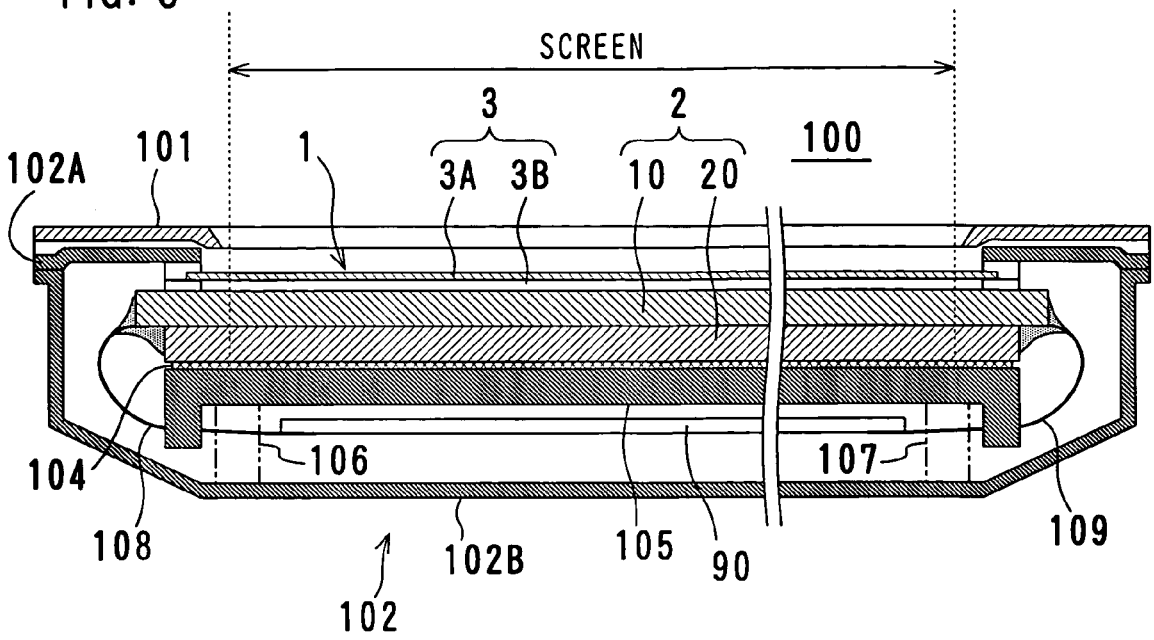
FIG. 3 is a cross-sectional cut along a-a line in FIG. 1.

FIG. 3 is a cross-sectional cut along a-a line in FIG. 1 and shows an inner structure of the display device. The display device 100 includes the display panel module 1 provided with the drive circuit board 90. The display panel module 1 is arranged in a conductive case (a shield casing) 102 to which the facing cover 101 is attached. The conductive case 102 includes a frame 102A that has an opening slightly larger than the screen 50 and a plate 102B that is molded into a thin box shape. The frame 102A is a front portion of the conductive case 102 and the plate 102B is a rear portion of the same.

The rear face of the display panel 2 is attached to a chassis 105 made of aluminum alloy via a double-sided adhesive tape 104, and the chassis 105 is fixed to the plate 102B via spacers 106 and 107. A drive circuit board 90 is placed on the rear side of the chassis 105. Flexible cables 108 and 109 are used for an electrical connection between the drive circuit board 90 and the plasma display panel 2. In this example, the display panel module 1 includes the front sheet 3, the plasma display panel 2, the double-sided adhesive tape 104, the chassis 105, the drive circuit board 90 and the flexible cables 108 and 109. It should be noted that a conductive tape for electromagnetic wave shielding which serves to make electrical connections between the front sheet 3 and the frame 102A is bonded to the front face of the plasma display panel 2 so as to overlap the end portion of the front sheet 3. Other structural elements to be placed in the conductive case 102 together with the display panel module 1, i.e., a power source, a video signal processing circuit and an audio circuit are omitted in FIG. 3.

The front sheet 3 is a layered film including a multi-layered functional film 3A having a thickness of 0.3 mm and an adhesive layer 3B having a thickness of approximately 0.5 mm that are put on each other. The plane size of the front sheet 3, more specifically the plane size of the functional film 3A is larger than the plane size of the screen and is smaller than the plane size of the plasma display panel 2. The plane size of the adhesive layer 3B is larger than that of the screen and is smaller than that of the functional film 3A.

In the display device 100, the front sheet 3 extends along the plasma display panel 2 in flat, and only the end portion thereof overlaps the frame 102A of the conductive case 102. The frame 102A is positioned in front of the front sheet 3 and the end portion of the front sheet is sandwiched between the frame 102A and the plasma display panel 2.

Figure 4:
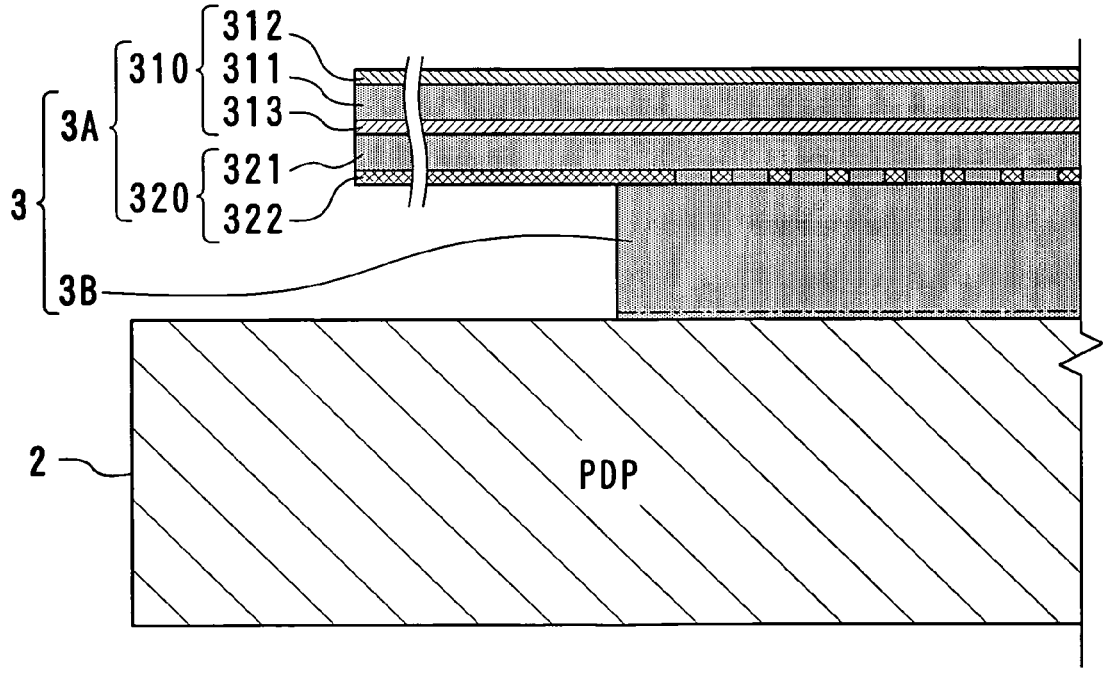
FIG. 4 shows a layer structure of a front sheet.

FIG. 4 shows a layer structure of the front sheet. The front sheet 3 is a layered film having a thickness of approximately 0.8 mm including, in order from the front side, an optical film layer 310 having a thickness of 0.2 mm, an EMI shield film layer 320 for shielding electromagnetic waves having a thickness of 0.1 mm and the adhesive layer 3B having a thickness of 0.5 mm. The optical film layer 310 and the EMI shield film layer 320 constitute the functional film 3A. The adhesive layer 3B is softer than the functional film 3A and has an impact absorbing function. A visible light transmittance of the entire front sheet 3 is approximately 40% after spectral luminous efficiency correction. The front sheet 3 weighs approximately 500 grams.

The optical film layer 310 includes a base film 311 made of PET (polyethylene terephthalate), an anti-reflection film 312 that is coated on the front side of the base film 311 and a coloring layer 313 that is formed on the rear side of the base film 311.

The anti-reflection film 312 prevents reflection of external light. The function of the anti-reflection film 312, however, may be changed from AR (anti reflection) to AG (anti glare). The anti-reflection film 312 includes a hard coat for increasing scratch resistance of the sheet surface up to pencil hardness 4H.

The coloring layer 313 adjusts visible light transmittance of red (R), green (G) and blue (B) for a color display and cuts off near infrared rays. The coloring layer 313 contains in a resin an infrared absorption coloring matter for absorbing light having a wavelength within the range between approximately 800 and 1000 nm, a neon light absorption coloring matter for absorbing light having a wavelength of approximately 580 nm and a coloring matter for adjusting visible light transmittance. An external light reflection factor of the optical film layer 310 is 3% after the spectral luminous efficiency correction, and the visible light transmittance is 55% after the spectral luminous efficiency correction. In addition, near infrared rays transmittance is 10% as an average in an absorption wavelength range.

The EMI shield film layer 320 for shielding electromagnetic waves includes a base film 321 made of PET and a conductive layer 322 having a thickness of 10 microns that is a copper foil with a mesh portion. The visible light transmittance of an area of the conductive layer 322 that overlaps the screen is 80%. Since the front surface of the conductive layer 322 is black, the EMI shield film layer 320 looks substantially coal-black when it is viewed through the optical film layer 310.

The base film 311 of the optical film layer 310 and the base film 321 of the EMI shield film layer 320 have a function of preventing a glass plate of the plasma display panel 2 from scattering when the glass plate is broken in an abnormal situation. In order to realize this function, it is desirable that a total thickness of the base film 311 and the base film 321 be equal to or more than 50 microns. In this example, a total sum of the thickness of the PET is equal to or more than 150 microns.

Figure 5:
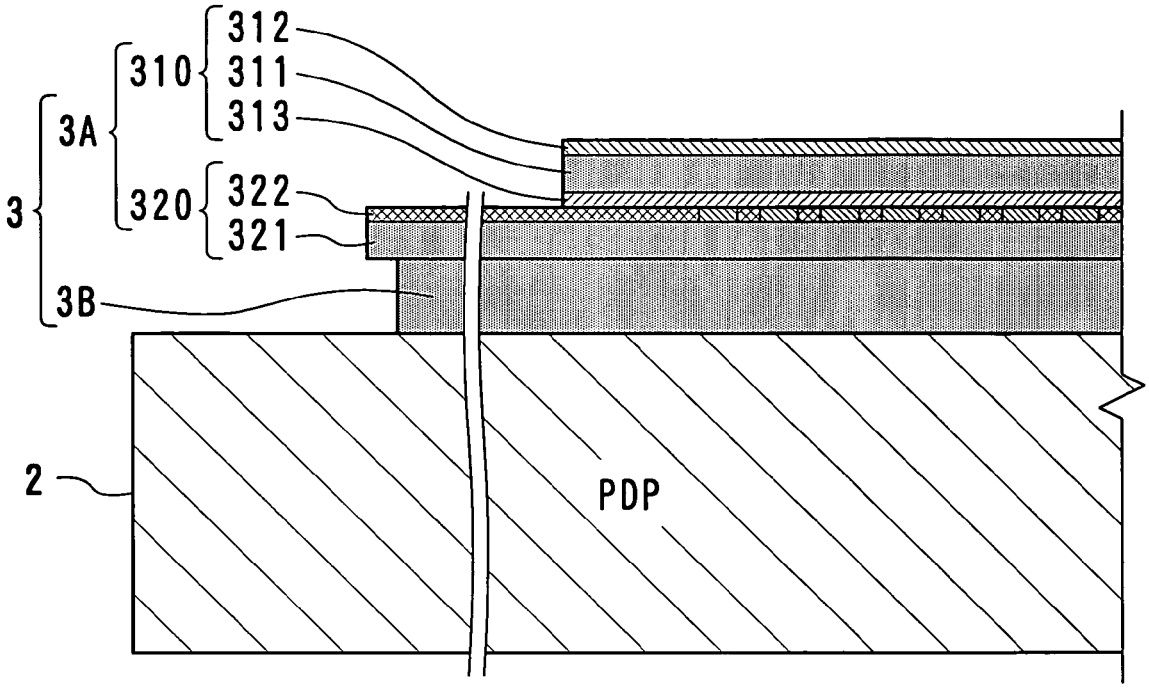
FIG. 5 shows another example of a layer structure of a front sheet.

FIG. 4 exemplifies the structure in which the conductive layer 322 of the EMI shield film layer 320 is placed on the side to which the plasma display panel 2 is bonded. Another structure is possible as shown in FIG. 5. Referring to FIG. 5, the conductive layer 322 is placed on the upper side of the base film 321, and the plasma display panel 2 and the base film 321 are bonded together. When this structure as shown in FIG. 5 is adopted, the optical film 310 is formed to be smaller than the EMI shield film 320 so that the peripheral portion of the conductive layer 322 is exposed. Thus, compared to the case as shown in FIG. 4, a structure of conductive contact between the conductive layer 322 and the frame 102A can be simplified.

The adhesive layer 3B is made of a soft acrylic resin, and a visible light transmittance thereof is 90%. The adhesive layer 3B is formed by applying the resin. When the resin is applied, it enters spaces of the mesh of the conductive layer 322, so that the conductive layer 322 is flattened. Thus, light scattering due to unevenness of the conductive layer 322 can be prevented.

Further, the adhesive layer 3B in this example has adequate separation properties. The adhesive layer 3B has relatively strong adhesiveness to the EMI shield film layer 320 made of PET and copper. In contrast, the adhesive layer 3B has relatively loose adhesiveness to the glass surface that is the front face of the plasma display panel 2. The adhesion force thereof is approximately 6N/25 mm on a 90° peel test at a feed rate of 200 mm per minute. For rework, it is desirably equal to or less than 10N/25 mm. It may be equal to or more than 2N/25 mm, desirably equal to or more than 5N/25 mm in order to realize stable attachment even if a mark is somewhat left on the film. When the front sheet 3 is peeled, the functional film 3A is not separated from the adhesive layer 3B so that the front sheet 3 is separated from the plasma display panel 2 normally. "Normally" means that an even peeled surface without a visible remaining matter can be obtained.

Furthermore, the adhesive layer 3B has foreign matter coverability unique to the present invention. The sufficient thickness of the adhesive layer 3B contributes to improvement in productivity of the plasma display panel modules 1. As described later with reference to FIG. 6, the adhesive layer 3B having an appropriate thickness eases restrictions on cleanliness of a place where a bonding process is performed.

Figure 6A:
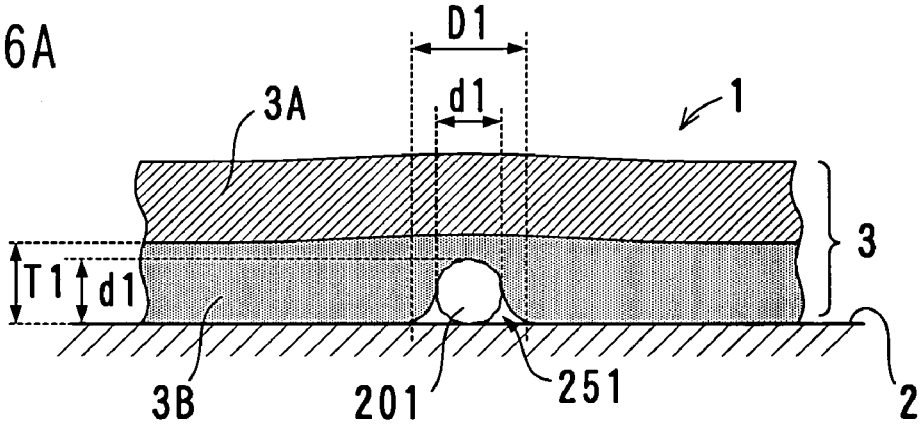
FIGS. 6A-6D are diagrams showing a concept of a state in which a functional film according to the present invention is bonded.
Figure 6B:
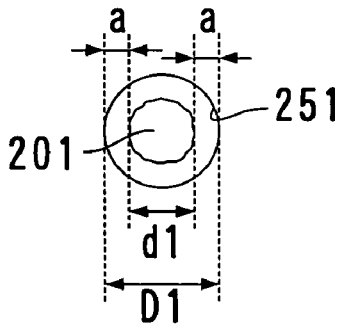
Figure 6C:
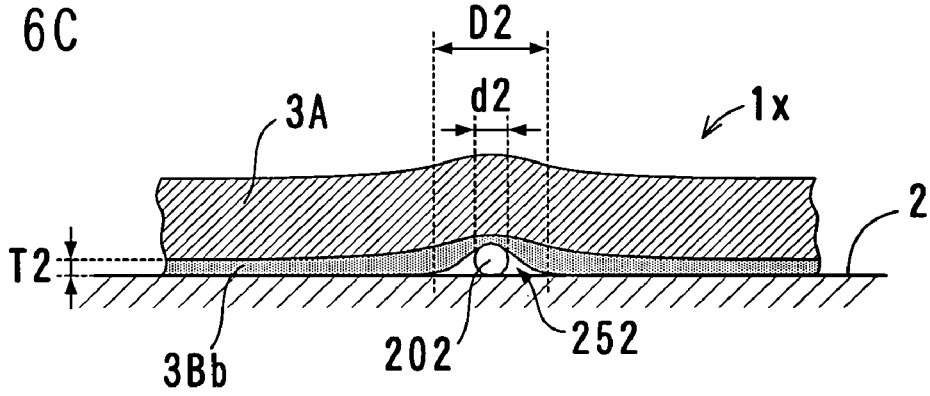
Figure 6D:
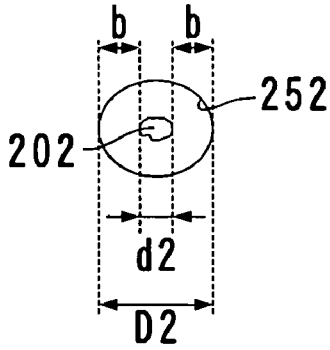

FIGS. 6A-6D are diagrams showing a concept of a state in which a functional film according to the present invention is bonded. FIG. 6A is a cross-sectional view of a principal part of the display panel module 1 according to the present invention and shows a function of the adhesive layer 3B. FIG. 6B is a front view of a void 251 shown in FIG. 6A. FIG. 6C is a cross-sectional view of a principal part of a display panel module 1*x* as a comparative example. FIG. 6D is a front view of a void 252 shown in FIG. 6C. In FIGS. 6C and 6D, structural elements corresponding to those in FIG. 6A are denoted by the same reference marks as in FIG. 6A.

In manufacturing the display panel module 1, dust (hereinafter referred to as a foreign matter) having a size equal to or more than 10 microns may be incidentally mixed in a bonding interface when the front sheet 3 is bonded to the plasma display panel 2. Even when a foreign matter having a size of approximately a few tens of microns is mixed, the foreign matter buries in the soft adhesive layer 3B, provided that the adhesive layer 3B has a thickness equal to or more than 100 microns (preferably, 200 microns through 500 microns=0.2 mm thorough 0.5 mm). More specifically, the adhesive layer 3B transforms to cover the foreign matter 201 as shown in FIG. 6A. The foreign matter 201, however, is not encompassed completely because the adhesive layer 3B does not have fluidity. As a result, the void 251 is generated around the foreign matter 201. The void 251 is an air bubble that appears around the foreign matter 201 and forms an area where the adhesive layer 3B has no contact with the plasma display panel 2. A material for the adhesive layer 3B is related to the size of the void 251. The material for the adhesive layer 3B requires good wettability to the glass surface as the front face of the plasma display panel 2. Good wettability to the glass surface can avoid expansion of the void 251 due to decompression even when the display panel module 1 is used under an environment where an atmospheric pressure is lower than that at the time of manufacture.

In the illustrated examples in FIGS. 6A and 6B, the foreign matter 201 has an almost spherical shape and has a dimension d1 smaller than a thickness T1 of the adhesive layer 3B. Referring to FIG. 6B, the void 251 has a circular shape surrounding the foreign matter 201 in a front view. Accordingly, the void 251 has a contour dimension D1 larger than the dimension d1 of the foreign matter 201.

It should be noted here that the void 251 does not necessarily disturb a display even if the void 251 has a dimension D1 of a relatively large value, e.g., approximately 100 microns. More specifically, a void was inspected which looks bright in visual observation of a display using the plasma display panel 2. The inspection proved that a distance between an edge of the void and a foreign matter, i.e., "a" shown in FIG. 6B has a value larger than 50 microns. Since this distance is almost equal around the foreign matter, the difference between the void dimension and the foreign matter dimension can be deemed to be as twice as the distance. The relationship of D1−d1=2a can be satisfied using the reference marks in FIG. 6B. Accordingly, a condition to be fulfilled by the display panel module 1 is that "a difference between a dimension of a foreign matter and a dimension of a void surrounding the foreign matter is smaller than 100 microns". Note that a phenomenon that the void looks bright is due to a difference of the index of refraction between the void and the glass plate, and that the void forms a tent-type lens-like defect, causing the phenomenon.

The condition described above should be satisfied under an operating environment defined by specifications of the display device 100. The void is apt to be larger as an atmospheric pressure of an operating environment is lower. Generally, the specifications assume the use under an environment having an atmospheric pressure of 700 hectopascals, e.g., uplands at an altitude of 3000 meters above sea level. Accordingly, the condition described above must be fulfilled under a low pressure environment of 700 hPa. The present invention is characterized in that a filter and a panel are bonded together and the filter and panel thus bonded is kept for one day or more at a temperature at least equal to or more than a room temperature before exposing the filter and panel to a pressure lower than an outside pressure when the filter is bonded to the panel. This makes the adhesive layer adapt to the glass surface and reduces a size of a void around a foreign matter. Further, even if the filter and panel is exposed to a decompression environment, a void is less likely to be larger.

FIGS. 6C and 6D show a structure that does not satisfy the condition mentioned above. The foreign matter 202 shown in FIGS. 6C and 6D has a dimension d2 smaller than the dimension d1 of the foreign matter 201 shown in FIGS. 6A and 6B. An adhesive layer 3Bb has, however, a thickness T2 smaller than the thickness of the foreign matter 202. For this reason, a distance "b" between an edge of the void 252 and the foreign matter 202 is larger than the distance a shown in FIG. 6B although the dimension D2 of the void 252 surrounding the foreign matter 202 is almost equal to the dimension D1 of the void 201 shown in FIGS. 6A and 6B. Accordingly, the dimension difference between the foreign matter 202 and the void 252, i.e., (D2−d2) is larger than the dimension difference illustrated in FIG. 6B, i.e., (D1−d1). This means that, in the structure as shown in FIG. 6C, the void 252 tends to be visible in a display compared to the void 251.

As described above, whether the void 251 or 252 is conspicuous depends on a difference between a void dimension and a foreign matter dimension. It is desirable, however, that the void 251 or 252 be smaller in order to eliminate visible display defects. Reduction in cell sizes along with higher resolution screens decreases permissible void dimensions. Based on this, the following definition concerning foreign matter coverability (foreign matter resistance) of the adhesive layer 3B is practical.

The foreign matter coverability that the adhesive layer 3B should have is a property that when a particle (a glass bead) having a size of 50 microns is placed on a glass plate that is the same as a glass substrate of the plasma display panel 2 in substance, the adhesive layer 3B transforms to limit to 100 microns or less a size of a void (an area where the adhesive layer 3*b* has no contact with the glass plate) generated around the particle at a bonding process of the functional film 3A. In particular, a glass bead or a black acrylic resin bead having a diameter of 50 microns is intentionally mixed in a bonding interface and a void dimension is measured. In this way, suitability of foreign matter coverability can be checked. Inventors of the present invention confirmed that dust mixed under a clean atmospheric environment does not affect display quality optically when a material for the adhesive layer is so selected that a diameter of a void generated due to a glass bead having a diameter of 50 microns is equal to or less than 100 microns, in other words, when a material for the adhesive layer is so selected that the ratio therebetween is equal to or less than 2.0.

Adherence of foreign matters can be prevented by bonding the front sheet 3 to the plasma display panel 2 in a clean room. In such a case, however, the front sheet 3 is bonded to the plasma display panel 2 prior to conducting an aging test and a lighting test of the plasma display panel 2. In the event that the plasma display panel 2 is determined to be defective after the lighting test, the front sheet 3 is waste in addition to the plasma display panel 2. Even if the front sheet 3 is detached from the plasma display panel 2 for reproduction, a process for peeling the front sheet 3 is added.

As described above, adherence of foreign matters having a dimension of approximately 100 microns is tolerated in the display panel module 1 according to this example. Stated differently, a bonding process of the front sheet 3 may be performed outside a clean room. Accordingly, the plasma display panel 2 manufactured in a clean room is carried from the clean room to outside. Then, the chassis 105 for heat dissipation and the drive circuit board 90 are incorporated in the plasma display panel 2 and a lighting test is performed. After that, the front sheet 3 is bonded to the plasma display panel 2 that passed the lighting test. This can eliminate time loss and resource loss such as a front sheet that is discarded or peeled. In addition, even when an end user damages a filter, manual repair is possible in a simple clean booth. The condition for manual repair is that an adhesion force is maintained at a value of 10N/25 mm or less even if it changes with time. When an adhesion force exceeds a value of 10N/25 mm, it takes much time to peel a filter by manual procedures. However, even when an adhesion force exceeds a value of 10N/25 mm, repair is possible in which a machine is used to peel a filter, a panel front face is cleaned and a new filter is bonded to the panel front face.

The upper limit of a foreign matter dimension depends on a cell size and is approximately 150 microns in practical cases. Adherence of foreign matters having a dimension smaller than the upper limit does not greatly lower luminance of a relevant cell. Relatively large foreign matters having a dimension equal to or more than 100 microns can be removed by using an adhesive roller or a brush. Here, a size of a foreign matter represents a size in the horizontal direction. With respect to optical visibility, discussion may be made for a foreign matter size and a void size in the horizontal direction. Descriptions are given earlier of a case where a size in the horizontal direction is the same as a size in the vertical direction. This is because a height of a foreign matter has a large influence on adhesion. Actual foreign matters have a height smaller than a size thereof in many cases. Such foreign matters are easy to be handled for adhesion. Here, suppose that a width of a filamentous foreign matter is regarded as a size thereof, because a void is generated along a length direction of filaments.

Figure 7:
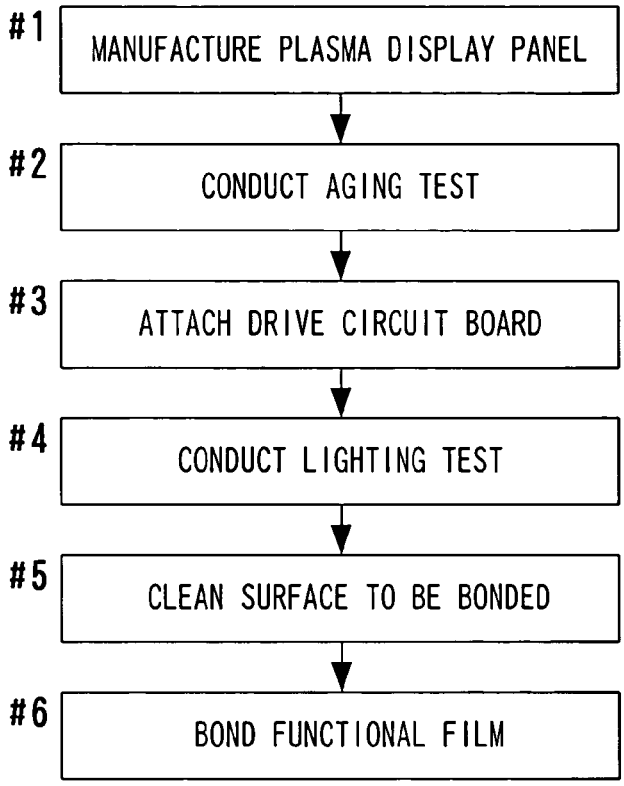
FIG. 7 is a diagram showing a manufacturing procedure of a display panel module.

FIG. 7 is a diagram showing a manufacturing procedure of a display panel module.

A plasma display panel 2 is manufactured (#1) and an aging process is performed (#2). A drive circuit board 90 is incorporated into the rear face of the plasma display panel 2 that was subjected to the aging process (#3). A lighting test is performed for operating the drive circuit board 90 and the plasma display panel 2. It is confirmed by the lighting test that the plasma display panel 2 and the drive circuit board 9 are acceptable products (#4). Then, the front face of the plasma display panel 2 is cleaned (#5) and a front sheet 3 including a functional film 3A and an adhesive layer 3B is bonded to the front face of the plasma display panel 2 (#6). When the front face of the plasma display panel 2 is cleaned, an adhesive roller or a brush is used to remove relatively large dust having a size of at least 100 microns or more.

The bonding process of the functional film 3A is preferably performed under a decompression environment equal to or less than 700 hPa. This prevents the appearance of air bubbles at a bonding interface, because the bonding interface has a negative pressure when a completed display panel module 1 is used under a standard atmospheric pressure environment. In addition, air bubbles are less likely to be generated at the bonding interface when the display panel module 1 is used under a low pressure environment of approximately 700 hPa. However, the functional film 3A may be bonded under a standard atmospheric pressure environment, provided that the conditions concerning a void described earlier are satisfied.

In the manufacturing procedures described above, the tests mentioned below are conducted for each predetermined lot or for each time when the material is changed, so that reliability of the display panel module 1 can be confirmed. Here, suppose that a bonding process and a measurement process are performed under an atmospheric environment having normal temperatures (25±10° C.) and normal pressures (1000±100 hPa). A foreign matter having a known dimension (a glass bead having a spherical shape with a diameter of 50 microns) can be intentionally interposed at an adhesive interface to observe the optical influence.

1. Foreign matter resistance test: A size d1 (50 microns) of a foreign matter and a size D1*s* of a void are measured immediately after (within ten minutes after) the functional film 3A is bonded to a glass plate as a dummy glass plate. When the result shows that D1*s* has a value equal to or less than twice the value of d1, that adhesive layer has desired coverability for dust having a size of approximately 100 microns that is predicted to be interposed at an adhesive interface under an atmospheric environment and such dust does not affect display quality.

2. Influence due to exposure: After bonding the functional film 3A to the dummy glass plate, it has been left for 72 hours, then to make a measurement of a size D1 of the void. It is preferable that D1 have the same or smaller value as the value of D1*s* that is the size immediately after the bonding process (D1≦D1*s*).

3. Influence due to decompression: The functional film 3A and the dummy glass plate with being bonded together has been exposed to a low pressure environment of 700 hPa for 30 minutes, then to make a measurement of the size D1 of the void under a normal pressure environment. It is desirable that D1 have the same or smaller value as the value of D1*s* that is the size immediately after the bonding process (D1≦D1*s*).

4. Influence due to high decompression: The functional film 3A and the dummy glass plate with being bonded together has been exposed to a low pressure environment of 300 hPa for 30 minutes, then to make a measurement of the size D1 of the void under a normal pressure environment. It is desirable that D1 have the same or smaller value as the value of D1*s* that is the size immediately after the bonding process (D1≦D1*s*).

5. Influence due to heating: The functional film 3A and the dummy glass plate with being bonded together has been exposed to a heating normal pressure environment of 60° C. for 24 hours, then to make a measurement of the size D1 of the void under a normal temperature environment. It is preferable that D1 have the same or smaller value as the value of D1*s* that is the size immediately after the bonding process (D1≦D1*s*).

6. Influence due to compression: The functional film 3A and the dummy glass plate with being bonded together has been exposed to a high pressure environment of 3 atm for one hour, then to make a measurement of the size D1 of the void under a normal pressure environment. It is preferable that D1 have the same or smaller value as the value of D1*s* immediately after the bonding process (D1≦D1*s*).

Figure 8:
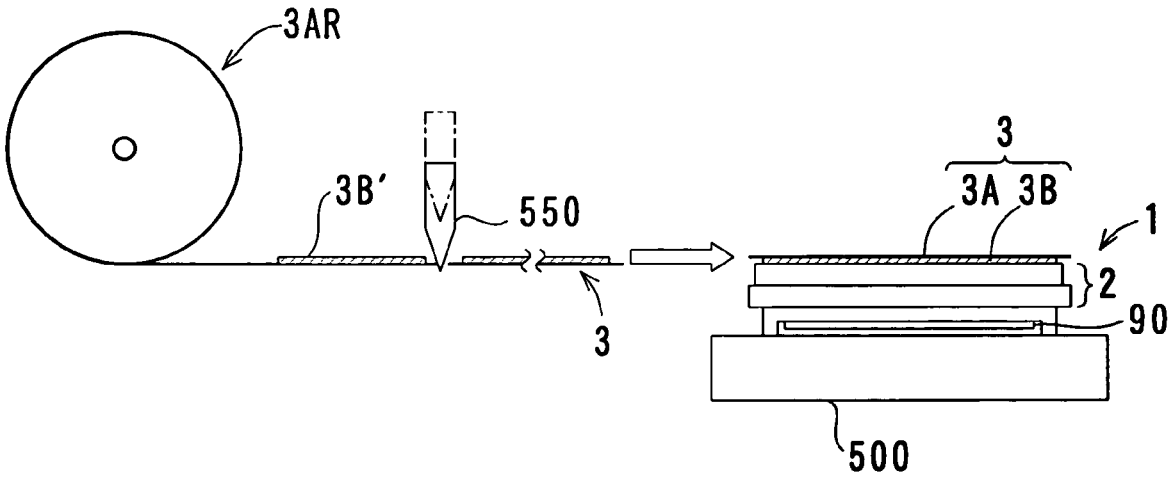
FIG. 8 is a diagram showing a general outline of a step for bonding the functional film.

FIG. 8 is a diagram showing a general outline of a step for bonding a functional film.

A multilayered film 3AR is drawn out of a roll on which the multilayered film 3AR that is formed by a roll-to-roll method is wound, and a resin 3B' to be the adhesive layer is applied on the multilayered film 3AR. The multilayered film 3AR is cut by a cutter 550, and the front sheet 3 thus obtained is bonded to a plasma display panel 2 that is placed on a table 500 after being tested. At this time point, the drive circuit board 90 is already attached to the plasma display panel 2. The plasma display panel 2 and the front sheet 3 are integrated to be the completed display panel device 1. In this bonding process, it is desirable that a material having cushioning properties such as urethane foam be used as a press roller for the bonding process in order to handle warpage of a surface of a plasma display panel. As another manufacturing method, it is possible that the multilayered film 3AR is reversed front side rear after the resin 3B' is applied on the same so that it is bonded to a panel module, and then it is cut.

Although a plasma display panel is exemplified in this specification, a device constituting a screen is not limited thereto. The present invention can be applied to devices whose screens are structured by other display panels such as ELs (Electro Luminescence), FEDs (Field Emission Displays) and liquid crystal displays.

The present invention promotes cost reduction in lightweight display devices where functional films are directly bonded to display panels and contributes to widespread use of flat display devices having large screens.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A method for manufacturing a display panel module including a display panel, a functional film that is bonded to a front face of the display panel, and a drive circuit board that is attached to a rear face of the display panel, the method comprising:

attaching the drive circuit board to the display panel;

conducting a lighting test of the display panel using the drive circuit board to confirm that the display panel is an acceptable product;

interposing an adhesive layer having a thickness equal to or more than 200 microns between the front face of the display panel and the functional film;

bonding the functional film to the display panel; and keeping the display panel to which the functional film is bonded for 24 hours or more under an environment of a temperature that is at least equal to or higher than a room temperature before exposing the display panel to which the functional film is bonded to an atmospheric pressure lower than an outside pressure at a time of the bonding step.

2. A method for manufacturing a display panel module including a display panel, a functional film that is bonded to a front face of the display panel, and a drive circuit board that is attached to a rear face of the display panel, the method comprising:

attaching the drive circuit board to the display panel;

conducting a lighting test of the display panel using the drive circuit board to confirm that the display panel is an acceptable product;

interposing an adhesive layer having a thickness equal to or more than 200 microns between the front face of the display panel and the functional film; and bonding the functional film to the display panel, wherein the functional film is bonded under an environment where an atmospheric pressure is lower than 700 hPa.

3. A display panel module comprising:

a display panel;

a functional film that is bonded to a front face of the display panel;

a drive circuit board that is attached to a rear face of the display panel; and an adhesive layer for bonding the functional film to the front face of the display panel, the adhesive layer having a thickness equal to or more than 200 microns, wherein a difference between a dimension of dust and a dimension of a void that appears around the dust is smaller than 100 microns, the dust adhering to the front face of the display panel and being covered by the adhesive layer.

4. A display panel module comprising:

a display panel;

a drive circuit board that is mounted on a rear face of the display panel; and a functional sheet that is bonded to a front face of the display panel, wherein the functional sheet has a multilayered structure including an optical film having an optical filter function and an EMI shield film having an electromagnetic wave shielding function, the functional sheet includes an adhesive layer on its surface to which the display panel is bonded, and the adhesive layer is made of a transparent adhesive soft material and has foreign matter coverability in which, when the functional sheet is bonded to a glass plate with a glass bead being placed on an adhesive interface, the glass bead having a diameter of 50 microns, a ratio between a diameter of a void that appears around the glass bead and a diameter of the glass bead is equal to or less than 2.0.

5. A display panel module according to claim 4, wherein the adhesive layer is made of adhesive transparent resin having a thickness equal to or more than 100 microns.

6. A display panel module comprising:

a display panel;

a drive circuit board that is mounted on a rear face of the display panel; and a functional sheet that has an optical filter function and is bonded to a front face of the display panel, wherein the functional sheet is peelably bonded to the front face of the display panel through an adhesive layer that is previously provided on one surface of the functional sheet, and the adhesive layer is made of transparent adhesive soft resin that has foreign matter coverability in which, when the adhesive layer is bonded to a predetermined glass plate with a glass bead being interposed in an adhesive interface, the glass bead having a diameter of 50 microns, a ratio between a diameter of a void that appears around the glass bead and a diameter of the glass bead is equal to or less than 2.0.

7. A display panel module according to claim 6, wherein the display panel is a plasma display panel, the adhesive layer has an uniform thickness equal to or more than 200 microns, and peel strength between the adhesive layer and the functional sheet is larger than peel strength between the adhesive layer and a front face of the plasma display panel.

8. A display panel module according to claim 6, wherein the display panel is a plasma display panel, the functional sheet is made of a multilayered film including an EMI shield film that has a metal mesh for shielding electromagnetic waves formed on a first base film and an optical film that has an optical film layer formed on a second base film, the multilayered film being formed by overlaying the optical film on the EMI shield film, and the adhesive layer is provided on a surface of the first base film, the surface being a rear side of a surface where the metal mesh is formed on the EMI shield film.

9. A display panel module according to claim 8, wherein the EMI shield film has a size equal to or smaller than a front substrate of the plasma display panel, a lower surface of the EMI shield film is peelably attached to the front substrate of the plasma display panel through the adhesive layer except a peripheral portion of the lower surface of the EMI shield film, and the optical filter is overlaid on an upper surface of the EMI shield film except a peripheral portion that is larger than the peripheral portion of the lower surface as a non-adhered part.

10. A plasma display device comprising:

the display panel module according to claim 4;

a casing for housing the display panel module; and the EMI shield film connected to the casing in a conductive manner, the EMI shield film being included in the functional sheet.

11. A method for manufacturing the display panel module according to claim 4, the method comprising the steps of:

mounting the drive circuit board on the rear face of the display panel;

conducting a display function test of the display panel; and performing a bonding process of the functional sheet under an atmospheric environment having normal temperatures.

12. A method according to claim 11, wherein the bonding process of the functional sheet is performed under a decompression environment lower than 700 hPa.

* * * * *